US009190741B2

(12) United States Patent
Cawood

(10) Patent No.: US 9,190,741 B2
(45) Date of Patent: Nov. 17, 2015

(54) HYBRID GROUNDING CONNECTOR

(71) Applicant: Thomas & Betts International LLC, Wilmington, DE (US)

(72) Inventor: Matthew D. Cawood, Deleon Springs, FL (US)

(73) Assignee: Thomas & Betts International LLC, Wilmington, DE (US)

( * ) Notice: Subject to any disclaimer, the term of this patent is extended or adjusted under 35 U.S.C. 154(b) by 43 days.

(21) Appl. No.: 14/169,828

(22) Filed: Jan. 31, 2014

(65) Prior Publication Data

US 2014/0273560 A1 Sep. 18, 2014

Related U.S. Application Data

(60) Provisional application No. 61/777,846, filed on Mar. 12, 2013.

(51) Int. Cl.

| | |
|---|---|
| ***H01R 4/00*** | (2006.01) |
| ***H01R 4/18*** | (2006.01) |
| *H01R 43/048* | (2006.01) |
| *H01R 4/60* | (2006.01) |

(52) U.S. Cl.

CPC ..... *H01R 4/187* (2013.01); *H01R 4/186* (2013.01); *H01R 4/60* (2013.01); *H01R 43/048* (2013.01); *Y10T 29/49213* (2015.01)

(58) Field of Classification Search

CPC ..... H01R 4/20
USPC ..... 439/874, 875, 877, 880; 174/84 R, 84 C, 174/94 R; 29/869

See application file for complete search history.

(56) References Cited

U.S. PATENT DOCUMENTS

| | | | | | |
|---|---|---|---|---|---|
| 918,078 | A | | 4/1909 | McCaffrey | |
| 2,025,848 | A | | 12/1935 | Collis | |
| 2,614,304 | A | | 10/1952 | Oetiker | |
| 2,664,844 | A | | 1/1954 | Siegrist et al. | |
| 2,894,056 | A | | 7/1959 | Bogese | |
| 2,945,085 | A | | 7/1960 | Billups | |
| 3,023,036 | A | | 2/1962 | Taylor, Jr. | |
| 3,095,337 | A | | 6/1963 | Chase | |
| 3,251,615 | A | | 5/1966 | Short, III | |
| 3,476,410 | A | | 11/1969 | Pastva, Jr. | |
| 3,519,982 | A | | 7/1970 | White, Jr. | |
| 3,601,783 | A | * | 8/1971 | Loose | 439/730 |
| 3,678,174 | A | * | 7/1972 | Ganzhorn | 174/84 R |
| 3,757,031 | A | | 9/1973 | Izraeli | |
| 3,807,885 | A | | 4/1974 | Coski | |
| 3,852,517 | A | * | 12/1974 | Fava | 174/84 R |
| 4,109,350 | A | | 8/1978 | Acre | |

(Continued)

FOREIGN PATENT DOCUMENTS

| | | |
|---|---|---|
| CA | 13995 | 1/1882 |
| CA | 141101 | 6/1912 |

(Continued)

*Primary Examiner* — Neil Abrams
(74) *Attorney, Agent, or Firm* — Hoffmann & Baron, LLP

(57) ABSTRACT

A hybrid grounding connector is provided which combines the positive attributes of currently used connections. A recess is pre-milled, formed or extruded into the body of a compression connector and the recess is pre-filled with solder. After conductors are installed in the connector, an external heat source is applied to heat the solder until it flows into strands of the conductors and forms a solidified joint of the compression connector.

13 Claims, 3 Drawing Sheets

(56) References Cited

U.S. PATENT DOCUMENTS

| | | | | |
|---|---|---|---|---|
| 4,373,235 | A | 2/1983 | Korgaonkar | |
| 4,454,644 | A | 6/1984 | Okazaki et al. | |
| 4,482,782 | A | 11/1984 | Sheppard | |
| 4,505,421 | A | 3/1985 | Gen et al. | |
| 4,667,869 | A | 5/1987 | Gen et al. | |
| 4,688,713 | A | 8/1987 | Gen et al. | |
| 4,710,080 | A | 12/1987 | Sheppard | |
| 4,722,471 | A | 2/1988 | Gray et al. | |
| 4,809,901 | A | 3/1989 | Gen et al. | |
| 4,832,248 | A | 5/1989 | Soni et al. | |
| 4,865,244 | A | 9/1989 | Morinaga | |
| 4,889,506 | A * | 12/1989 | Connolly et al. | 439/874 |
| 4,914,267 | A * | 4/1990 | Derbyshire | 219/85.1 |
| 4,920,642 | A | 5/1990 | Yanai et al. | |
| 4,940,179 | A | 7/1990 | Soni | |
| 4,998,326 | A | 3/1991 | Oetiker | |
| 5,007,666 | A | 4/1991 | Kyfes | |
| 5,025,554 | A | 6/1991 | Dohi | |
| 5,393,932 | A * | 2/1995 | Young et al. | 174/84 R |
| 5,504,275 | A | 4/1996 | Scramoncin | |
| 5,579,575 | A * | 12/1996 | Lamome et al. | 29/860 |
| 5,594,211 | A | 1/1997 | Di Troia et al. | |
| 5,635,676 | A | 6/1997 | Piriz | |
| 6,247,500 | B1 | 6/2001 | McMahon | |
| 6,309,260 | B1 * | 10/2001 | Shannon | 439/772 |
| 6,452,103 | B1 | 9/2002 | Piriz | |
| 6,481,061 | B1 | 11/2002 | Andre et al. | |
| 6,640,873 | B2 | 11/2003 | Triantopoulos et al. | |
| 6,677,529 | B1 * | 1/2004 | Endacott | 174/84 R |
| 6,793,003 | B2 | 9/2004 | Triantopoulos et al. | |
| 6,818,830 | B2 | 11/2004 | O'Grady et al. | |
| 6,846,989 | B2 | 1/2005 | Sokol et al. | |
| 7,026,552 | B2 | 4/2006 | Sokol et al. | |
| 7,053,307 | B2 | 5/2006 | Kossak et al. | |
| 7,121,001 | B2 | 10/2006 | O'Grady et al. | |
| 7,183,489 | B2 | 2/2007 | Kossak et al. | |
| 7,511,224 | B1 * | 3/2009 | Kossak | 174/84 R |
| 7,655,863 | B2 | 2/2010 | Kossak | |
| 7,708,608 | B2 | 5/2010 | Soh | |
| 8,047,476 | B2 | 11/2011 | Van Walraven | |
| 2010/0068946 | A1 | 3/2010 | Lai | |
| 2014/0273560 | A1 * | 9/2014 | Cawood | 439/98 |

FOREIGN PATENT DOCUMENTS

| | | |
|---|---|---|
| CA | 1260098 | 9/1989 |
| CA | 1286008 | 7/1991 |
| CA | 2074936 | 7/1991 |
| CA | 2084504 | 12/1991 |
| CA | 2057279 | 6/1992 |
| CA | 2113816 | 2/1993 |
| CA | 2127286 | 8/1993 |
| CA | 2142703 | 5/1994 |
| CA | 2173351 | 5/1995 |
| CA | 1337030 | 9/1995 |
| CA | 2196092 | 2/1996 |
| CA | 2287637 | 5/2000 |
| CA | 2306988 | 8/2001 |
| CA | 2630244 | 11/2007 |
| CA | 2683284 | 11/2008 |
| CA | 2684202 | 11/2008 |
| CA | 2685765 | 11/2008 |
| CA | 2703937 | 5/2009 |
| CA | 128677 | 8/2009 |
| CA | 2676943 | 3/2010 |
| CA | 2765944 | 1/2011 |
| CA | 2714533 | 3/2011 |
| EP | 1403965 A1 | 3/2004 |
| EP | 1503453 A1 | 2/2005 |
| WO | 2011096527 | 8/2011 |
| WO | 2011128225 | 10/2011 |
| WO | 2011131303 | 10/2011 |

* cited by examiner

HYBRID GROUNDING CONNECTOR

FIELD OF THE INVENTION

In general, the present invention relates to a hybrid connector for electrically grounding a plurality of conductors together. The connector comprises a recess which has been milled or formed into the body of the connector and pre-filled with solder to be heated and melted once the conductors have been installed in the connector.

BACKGROUND

There are three common methods of providing a grounding connection for a plurality of conductors. These methods include exothermic connectors, mechanical connectors and compression connectors. Each method has its own advantages and disadvantages. Exothermic connectors are believed to be the superior connection among the three mentioned methods, as it yields a solid conductor mass if the method is carried out properly. The solid joint that is produced is not susceptible to mechanical or electrical degradation. However, some disadvantages of this method include the types of tools required and the susceptibility of this method to environmental conditions such as rain or humidity. Mechanical connectors are easy to install and require no special tools for installation of conductors. However, mechanical connectors are often not preferred as a grounding method, as a tightened mechanical connector can become loose through vibrations over time which does not provide a permanent connection. Compression connectors are considered to form a permanent connection, but are believed in some instances to be inferior to exothermic connections due to small voids which can exist in the compressed joint which may allow moisture to penetrate the joint, leading to oxidation or degradation of the connection over time. Compression connectors are considered to be inferior to exothermic for resistance to fault currents. An improved connector which combines the positive attributes of the previously described methods is desired.

SUMMARY OF THE INVENTION

The present invention provides a hybrid connector for electrically grounding a plurality of conductors together. The connector comprises a recess which has been milled, extruded or formed into an interior wall of the body of the connector and pre-filled with solder. The interior walls of the connector can also be coated with flux material to promote solder flow. Conductors are installed within the connector, compressed, and an external heat source is applied which is sufficiently hot to melt the solder which is contained in the recess. The heat source remains applied until the melted solder flows into the strands of the conductors, thereby solidifying the joint of the connector.

DETAILED DESCRIPTION OF THE PREFERRED EMBODIMENT(S)

Figure 1:
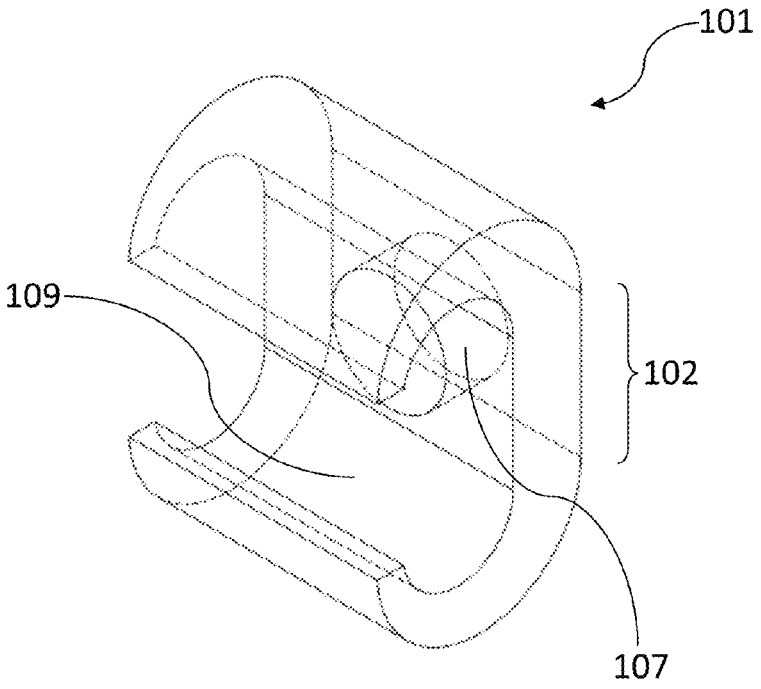
FIG. 1 is a front perspective view of a hybrid connector of the present invention.
Figure 2:
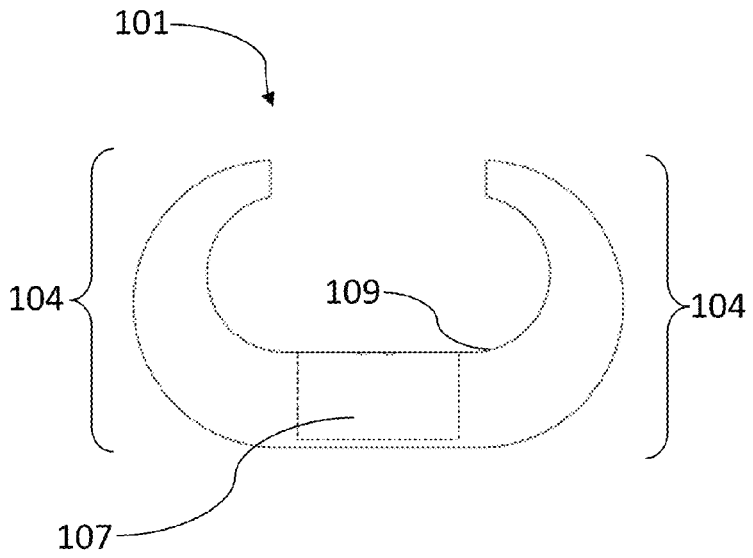
FIG. 2 is a side elevation view of a hybrid connector of the present invention.

The above and other features, aspects and advantages of the present invention will now be discussed in the following detailed description of preferred embodiments and appended claims, which are to be considered in conjunction with the accompanying drawings in which identical reference characters designate like elements throughout the views.

Shown in FIG. 1 is a front perspective view of a hybrid connector 101 for electrically grounding a plurality of conductors together. The connector 101 shown in FIG. 1 and also in FIGS. 2-6 is a compression type connector that also has attributes of an exothermic connector. FIG. 1 shows a substantially C-shaped compression type connector 101. The connector comprises a straight portion 102 and two inwardly curved portions 104, which are more clearly shown in FIG. 2, to form the C-shape. Milled or formed into an inner wall 109 of the connector 101 is a recess 107. This recess 107 is pre-filled with solder during the manufacturing process of the connector 101. It is preferred that the solder which is used to fill the recess be silver solder, but it is understood that the solder may be of any other type of solder material. FIG. 2 is a side elevation view of the hybrid connector which is shown in FIG. 1, and the recess 107 which is discussed above can be clearly seen in FIG. 2.

Figure 3:
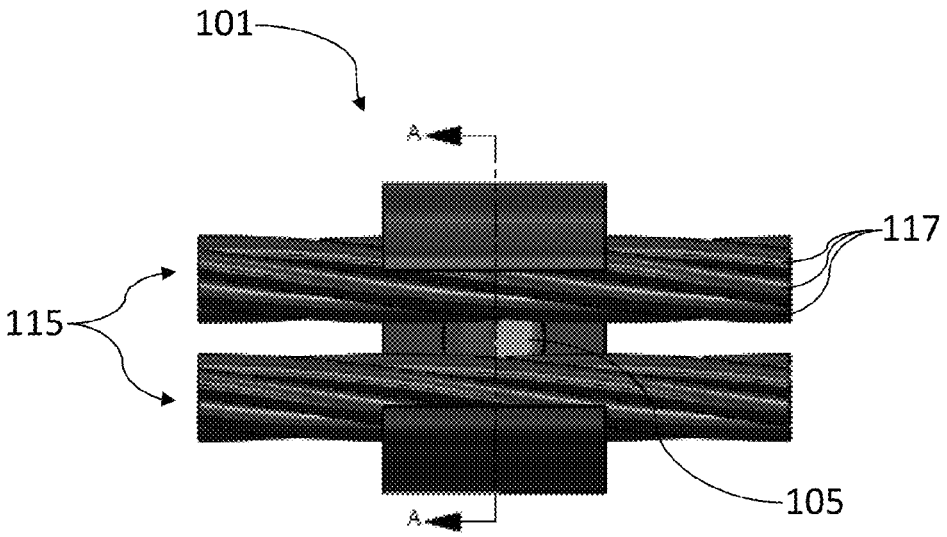
FIG. 3 is a front elevation view of a hybrid connector of the present invention being installed on a plurality of conductors.
Figure 4:
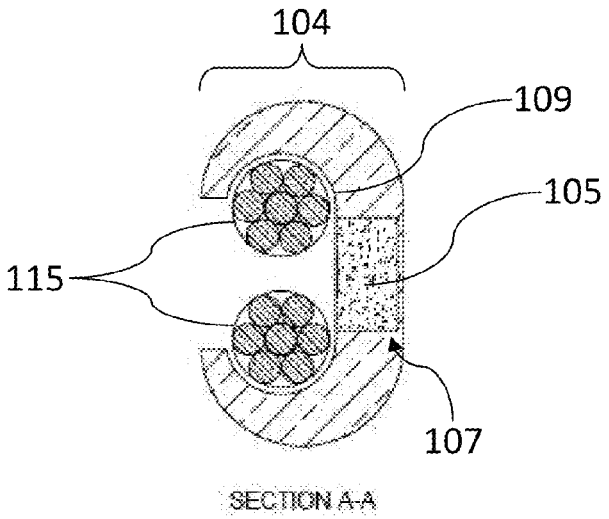
FIG. 4 is a side elevation view of a hybrid connector of the present invention being installed on a plurality of conductors.

Shown in FIG. 3 is a front elevation view of the C-shaped hybrid compression connector 101. In FIG. 3, it can be seen that the connector 101 has been installed on a plurality of conductors 115, the conductors 115 being comprised themselves of a plurality of cable strands 117. The conductors 115 fit into the curved portions 104 of the C-shaped connector 101, as shown in FIG. 4, and contact the inner wall 109 of the connector 101 which contains the recess 107 that has been filled with solder material 105.

Figure 5:
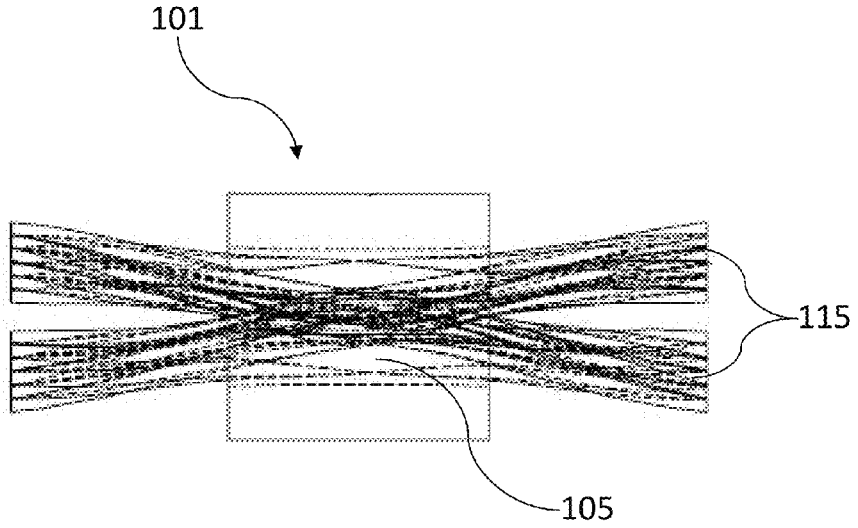
FIG. 5 is a front elevation view of a hybrid connector of the present invention which has been crimped around a plurality of conductors.
Figure 6:
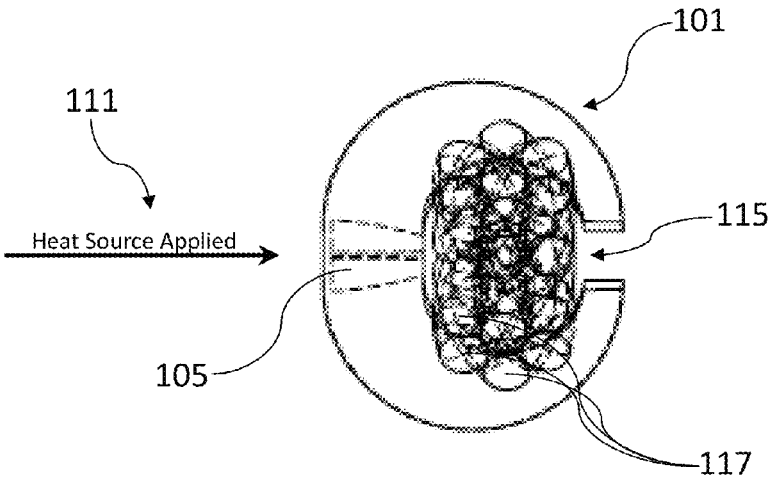
FIG. 6 is a side elevation view of a hybrid connector of the present invention which has been crimped around a plurality of conductors with an external heat source applied.

Shown in FIGS. 5 and 6 are front elevation views and side elevation views, respectively, of the C-shaped hybrid compression connector 101. In FIGS. 5 and 6, the connector 101 is shown crimped around the plurality of conductors 115. Once the connector 101 is crimped around the conductors 115, the resulting compressed joint could possibly contain small voids which could potentially allow moisture to penetrate the connection and lead to oxidation or degradation of the connection over time. However, the recess 107 which has been pre-filled with the solder material 105 prevents this from happening. In FIG. 6, it is shown that a heat source 111 is applied to the connector 101 in order to heat the solder material 105. Once the solder material 105 is heated to its melting point, which is lower than the melting point of the material which the connector is comprised of, then the solder begins to flow into the strands 117 of the conductors 115. The heat source 111 remains applied until the solder 105 is fully melted and integrated into the strands 117 of the conductors 115, resulting in a solid conductor mass.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

What is claimed is:

1. A hybrid compression connector for providing a grounding connection, the connector comprising:

a compression connector for receiving a plurality of conductors which are comprised of multiple strands;

wherein an interior wall of the compression connector comprises a recess filled, at least partially, with solder; and wherein after the compression connector has been crimped around the conductors, a heat source is applied to melt the solder until it flows into the strands of the conductors to solidify the connection and prevent moisture intrusion.

2. The hybrid compression connector of claim 1, wherein the interior walls of the compression connector have a coating of flux which has been pre-applied to them.

3. The hybrid compression connector of claim 1, wherein the solder which at least partially fills the recess is silver solder.

4. The hybrid compression connector of claim 1, wherein, prior to the heat source being applied, the solder remains in the recess by friction fit or by being soldered into position.

5. The hybrid compression connector of claim 1, wherein the material which is used to form the connector has a higher melting point than that of the solder which at least partially fills the recess.

6. The hybrid compression connector of claim 1, wherein the connector is substantially C-shaped and comprises a wall which forms a straight portion and walls which form two opposite and inwardly curved portions to form the C-shape and wherein an interior wall of the straight portion of the connector comprises the recess filled, at least partially, with solder.

7. A method for providing a grounding connection using a hybrid grounding connector, comprising the steps of:

milling, forming or extruding a recess into an inner wall of the connector;

filling the recess, at least partially, with solder;

placing a plurality of conductors which are comprised of multiples strands in the connector;

crimping or tightening the connector around the plurality of conductors until the conductors are secure; and applying an external heat source to the connector in order to melt the solder to allow it to flow into the strands of the conductors, thereby solidifying the connection and preventing moisture intrusion.

8. The method of claim 7, wherein the connector is a compression connector.

9. The method of claim 7, wherein the connector is a substantially C-shaped compression connector and comprises a wall which forms a straight portion and walls which form two opposite and inwardly curved portions to form the C-shape and wherein an interior wall of the straight portion of the connector comprises the recess filled, at least partially, with solder.

10. The method of claim 7, wherein all interior walls of the connector which contact the conductors have a coating of flux which has been pre-applied to them.

11. The method of claim 7, wherein the material which is used to form the connector has a higher melting point than that of the solder which at least partially fills the recess.

12. The method of claim 7, wherein the solder which at least partially fills the recess is silver solder.

13. The method of claim 7, wherein, prior to the heat source being applied, the solder remains in the recess by friction fit or by being soldered into position.

* * * * *